US009119446B1

(12) United States Patent
Dryden

(10) Patent No.: US 9,119,446 B1
(45) Date of Patent: Sep. 1, 2015

(54) SNAP PIN

(71) Applicant: Kimberly Suzanne Dryden, Bowdoin, ME (US)

(72) Inventor: Kimberly Suzanne Dryden, Bowdoin, ME (US)

( * ) Notice: Subject to any disclaimer, the term of this patent is extended or adjusted under 35 U.S.C. 154(b) by 0 days.

(21) Appl. No.: 13/987,553

(22) Filed: Aug. 5, 2013

(51) Int. Cl.
*A44C 1/00* (2006.01)

(52) U.S. Cl.
CPC ..... *A44C 1/00* (2013.01)

(58) Field of Classification Search
CPC ..... A44C 1/00
USPC ..... 63/20; 24/709.2, 706.2
See application file for complete search history.

(56) References Cited

U.S. PATENT DOCUMENTS

| | | | | | |
|---|---|---|---|---|---|
| 235,683 | A | * | 12/1880 | Jeanne | 63/1.16 |
| 645,108 | A | * | 3/1900 | Lincks | 24/709.2 |
| 717,555 | A | * | 1/1903 | Dover | 24/709.2 |
| 863,826 | A | * | 8/1907 | Aiken | 24/13 |
| 1,334,277 | A | | 3/1920 | Bartlett | |
| 1,781,737 | A | * | 11/1930 | Stafford | 24/709.2 |
| 2,463,692 | A | * | 3/1949 | Holden | 24/518 |
| 3,732,599 | A | | 5/1973 | Morissette | |
| 3,806,997 | A | | 4/1974 | Niwa | |
| 5,156,023 | A | | 10/1992 | Bevolo | |
| 5,709,013 | A | | 1/1998 | Stanback | |
| 5,926,920 | A | | 7/1999 | Dennison | |

* cited by examiner

*Primary Examiner* — Jack W Lavinder
(74) *Attorney, Agent, or Firm* — Coleman & MacDonald Law Office

(57) ABSTRACT

The preferred embodiment of my pin is a simple two part pin that consists of a pin assembly and a decorative cover plate. The pin assembly consists of a pin having a loop on top of the pin and a stabilizing post that intersects the upper region of the leg of the pin away from the point or bottom of the pin. Two bumps placed at the ends of the post for alignment and slippage. The decorative cover plate being any non-solid or solid shape, and having two snap-in clamps and a guard that directly correspond with both arms of the post and the point of the pin. Thus by creating 3 points of contact the back of the cover plate and supporting more of the cover plate when attached than a pin alone will support and creating more stability for both pin and material. The pin supports other jewelry ornamentation and fabrics to give a designer look to any fabric or like material whether that is clothing, arts crafts or home décor.

7 Claims, 5 Drawing Sheets

SNAP PIN

CROSS-REFERENCE TO RELATED APPLICATIONS

This application claims the benefit of provisional patent application Ser. No. 61/742,531, filed 2012 Aug. 13 by the present inventor.

BACKGROUND

Prior Art

The following is a tabulation of some prior art that presently appears relevant:

| U.S. Patents | | | |
|---|---|---|---|
| Pat. No. | Kind Code | Issue Date | Patentee |
| 3,806,997 | B1 | Apr. 30, 1974 | Niwa |
| 5,156,023 | B1 | Oct. 20, 1992 | Bevolo |
| 3,732,599 | B1 | May 15, 1973 | Morissette |
| 5,709,013 | B1 | Jan. 20, 1998 | Stanback |
| 1,334,277 | B1 | Mar. 23, 1920 | Bartlett |

Fibula, and brooches, now commonly known as pins, date to circa 800 AD and were functional as well as ornamental. Early fibulas were made from bone, then later of ceramic and subsequently of metal and for generations have not changed much from the common brooch or safety pin style.

Apparel jewelry items are available in many forms such as brooches, pins, collar pins, badges, lapel pins and many more. However the one thing all of these have in common is the fact that they are limited to just a few functions. Brooches and pins for ornamentation, collar pins for collars, badges for name and identification and so on.

Several adapters have been designed to expand the form and function of the apparel or clothing jewelry such as other pins or badges with an adapter system as in U.S. Pat. No. 5,926,920 or U.S. Pat. No. 3,806,997 which creates more functionality but really never seemed to catch on.

Multi-purpose pins have also been developed like U.S. Pat. No. 5,156,023 that have additional uses and functionality but are costly to manufacture because many parts are involved.

Decorative pins such as U.S. Pat. No. 3,732,599 also seem to be multi-purpose pins but are still limited to the solid faced pin and are not designed for attachments Ornamental support devices have been developed like U.S. Pat. No. 5,709,013 to help hold the ornamental jewelry in place so name tags and jewelry do not flop back and forth on the material they are attached to. The standard brooch or pin utilizes a thin pin through the material which provides no stabilization of side-to-side movement. The pins latch and hinge keep the cover plate too far away from the material to allow the ornamental top to lay flatter on the surface of the material that it is pinned to. The standard safety pin U.S. Pat. No. 1,334,277 is still the standard for a functional pin but has limited decorative appeal. With all the disadvantages of manufacturing costs, complicated systems and limited functions thus far, the jewelry industry mostly continues to use the time honored standard brooch, collar pin, lapel pin, corsage pin, etc.

The standard brooch is now manufactured with a pin assembly that is sold separate from the ornamental cover or designs thus allowing the wearer to make or design the cover themselves. The pin assembly having a rectangular plate with a pin that is hinged to one end of the back side of a cover plate and a receiving latch on the other end for the point of the pin. If an individual purchases this pin assembly to install a design on the top side of the rectangular cover plate, they are still restricted to designing around a solid rectangular plate which limits the functions of the pin. More and more jewelry manufactures are finding this method to be cost effective also. Therefore in manufacturing a brooch or pin there would be the design to the cover plate, cover plate to the pin assembly and then the pin assembly itself being the pin, hinge and the latch to the cover plate.

SUMMARY

The preferred embodiment of my pin consists of two parts, a decorative cover and a pin assembly. The decorative cover being anon-solid shape and or solid shape and having the direct corresponding attachments on the back side for the pin assembly to be attached. With the pin assembly consisting of a pin having a loop on top of the pin and a stabilizing post that intersects the upper region of the leg of the pin away from the point of the pin. With less space between the back of the cover and the pin that is applied to the material this gives the decorative cover more support and stabilization to the material.

Another advantage to the decorative cover is that it can be solid or non-solid allowing ribbons, lace or the like to be drawn through the center of the pin, or multiple pins for a bigger design. The loop at the top of the pin also allows chains to be attached to a pin for an ornament to dangle from or multiple pins giving amore elaborate design across the material. The pin would also be useful in several different industries other than jewelry like arts and crafts or home décor.

The pin assemblies' being removable from the decorative cover also makes applying the pin more accurately and simply to the material being used for the pin.

Other advantages of one or more aspects will be apparent from a consideration of the drawings and ensuing description.

DRAWINGS

Figures

For amore detailed description of the preferred embodiment of my pin, references will now be made to the accompanying drawing wherein.

Drawings-Reference Numerals

| | | | |
|---|---|---|---|
| 101 | decorative cover solid shape | 102 | design |
| 103 | loop | 104 | snap-in clamp |
| 105 | post | 106 | guard |
| 107 | top of pin assembly | 108 | eye |
| 109 | leg of pin | 110 | point of pin |
| 111 | weld or like method | 112 | space for fabric material |
| 113 | opening in snap-in clamp | 114 | open shape and open center cover |
| 115 | closed shape with open center cover | 116 | pin extended into loop |
| 117 | ornamental feature | 118 | alternate embodiment use |
| 119 | chain | 120 | ribbon |
| 121 | bump that has been enlarged | | |
| 150 | Pin Assembly | 200 | Ornamental Pin |

DETAILED DESCRIPTION

FIGS. 1, 2, 3, 5, 7, 8, 10, 11, 12

Figure 1:
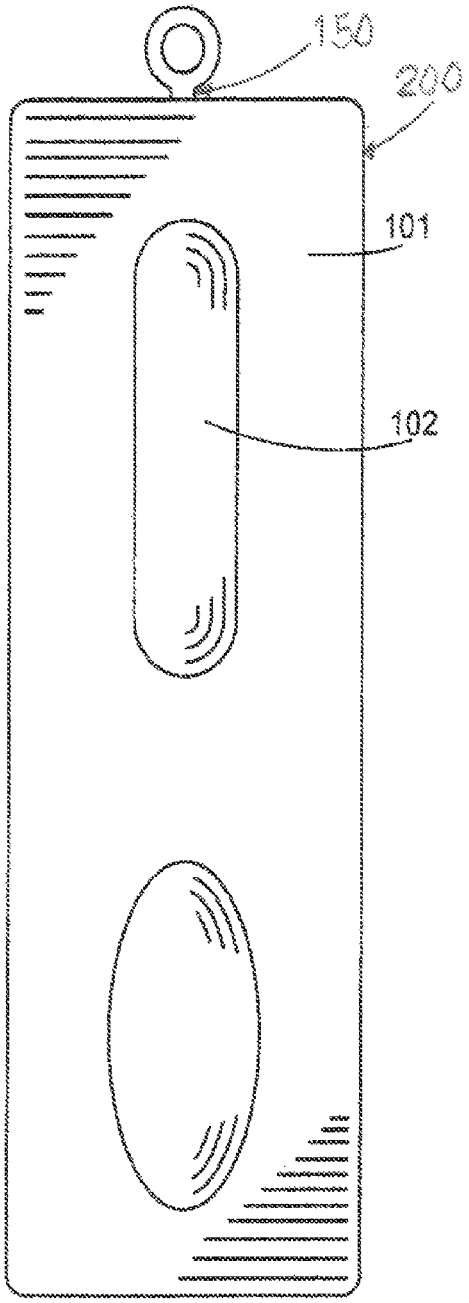
FIG. 1 is a front view of the pin with the pin assembly attached to one example of a decorative cover and constructed in accordance with the preferred embodiment.
Figure 2:
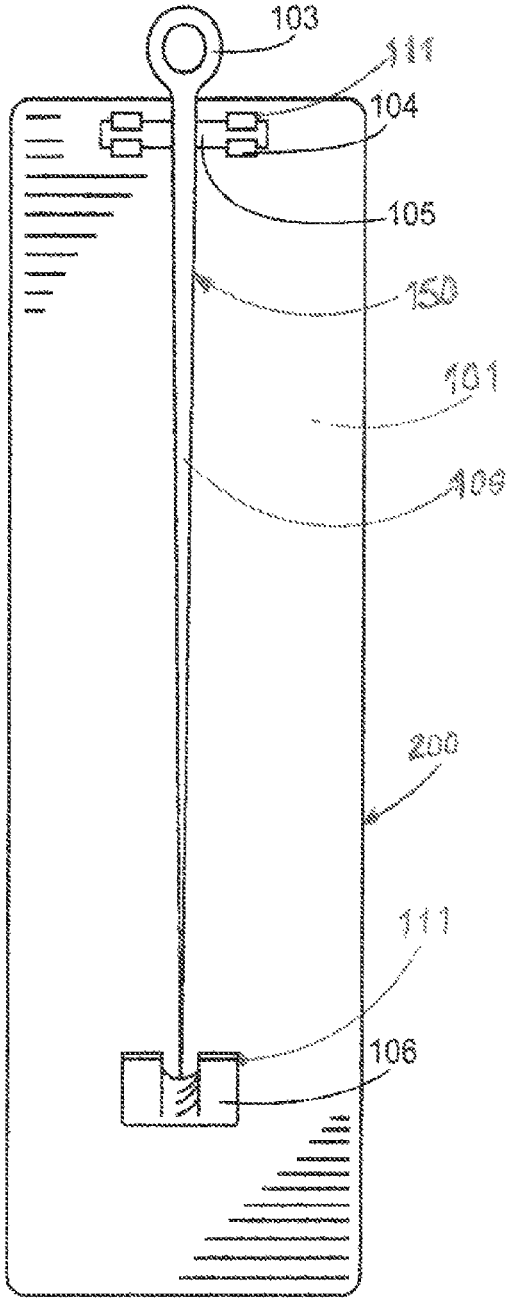
FIG. 2 is aback view of the pin with the pin assembly attached to the decorative cover as shown in FIG. 1.

An embodiment of my pin is illustrated in FIG. 1 (front view). The preferred embodiment of my pin is illustrated in FIG. 2 (back view) is a two part pin 200 comprised of a decorative cover 101 with a removable pin assembly 150. The two parts of the preferred embodiment of my pin are made of like materials, colors, sizes and designs as any other brooch or pin.

Figure 8:
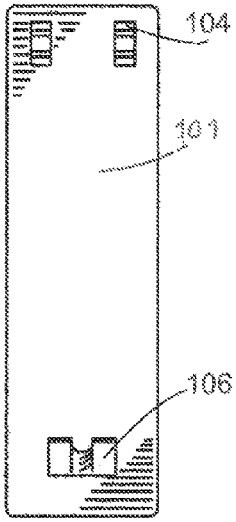
FIG. 8 is the back view of a decorative cover without the pin assembly shown in FIG. 2.
Figure 10:
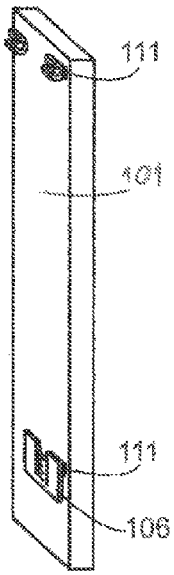
FIG. 10 is a perspective view of the left side of a decorative cover without the pin assembly shown in FIG. 2.

The decorative cover 101 is decorative on one side and has two snap-in clamps 104 and a guard 106 on the back side shown in FIG. 8. The two snap-in clamps attached to the back side of the decorative cover will directly correspond to the outer arms of the post 105 away from the leg of the pin 109 and before the ends of the post. The two snap-in clamps having the same inside diameter as the diameter of the post. The two snap-in clamps are also affixed to the back side of the decorative cover by solder, welding, cement, adhesive or like method 111 shown in FIG. 10. The guard 106 is a thin rectangular plate that is bent out on the side adjacent to the placement of the snap-in clamps. The guard is also affixed to the back side of the decorative cover by solder, welding, cement, adhesive or like method 111 shown in FIG. 10. The guard affixed to the back side of the decorative cover will directly correspond to the point of the pin 110 of the pin assembly.

Figure 5:
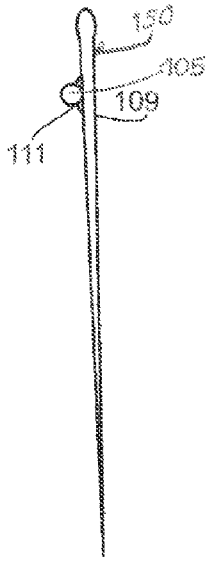
FIG. 5 is a left side view of the pin assembly shown in FIG. 2.
Figure 6:
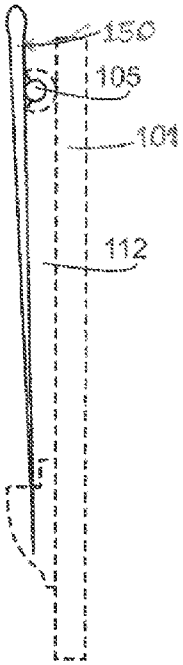
FIG. 6 is aright side view of the pin assembly shown in FIG. 2.
Figure 7:
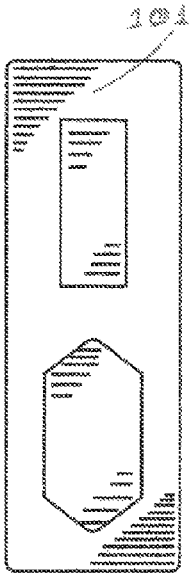
FIG. 7 is the front view of an alternate decorative cover without the pin assembly shown in FIG. 1.
Figure 11:
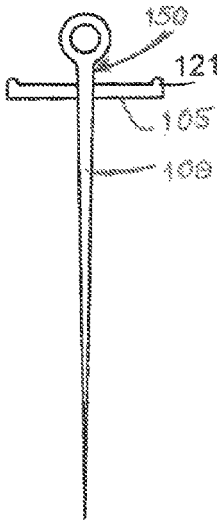
FIG. 11 is a front view of a pin assembly with the bump on top and larger than needed but showing the placement before the end of the post.
Figure 12:
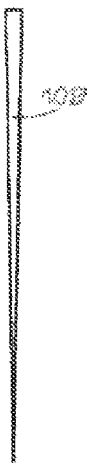
FIG. 12 is a front view of a pin shown in FIG. 3.

The pin assembly being a pin FIG. 12 with a loop 103 shown in FIG. 2 formed on the top of the pin 107 and a post 105 that is affixed to and intersects the upper leg of the pin away for the point 110. The intersection of the post to the leg of the pin is affixed by solder, welding, cement, adhesive or the like at the intersection 111 shown in FIG. 5. Let it be understood that the length of the pin and post of the pin assembly depend on the placement of the counterparts on the back of the decorative cover as shown in FIG. 8. A bump 121 shown in FIG. 11 placed anywhere between each end and the snap-in clamp intersection on the post to stabilize the post and for better alignment.

Operation

FIGS. 2, 3, 6, 8, 9

Figure 3:
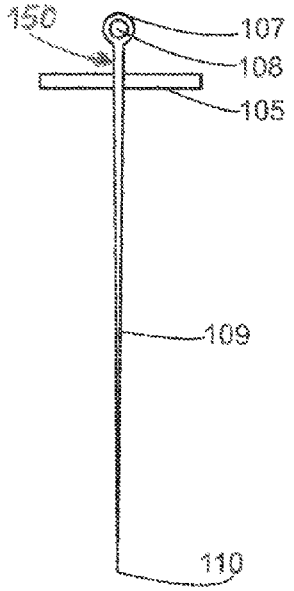
FIG. 3 is a front view of the pin assembly shown in FIG. 2.
Figure 4:
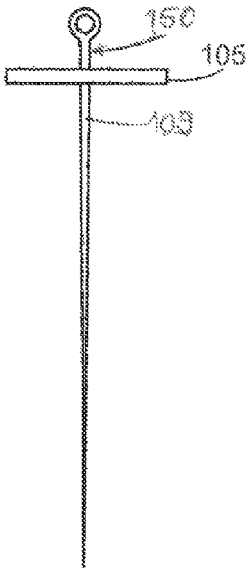
FIG. 4 is aback view of the pin assembly shown in FIG. 2.

To better understand how pin 200 is configured refer first to FIG. 3. (the from view of the pin assembly 150), next to FIG. 8 (the back view of the decorative cover 101), and then to FIG. 2 (the back view of the decorative cover attached to the pin assembly).

To remove the pin assembly 150, (shown in FIG. 3) from the decorative cover 101, hold the cover 101 and pull the top of the pin assembly away from the decorative cover. The post 105 will simultaneously be pulled through the openings 113, shown in FIG. 9, of the two snap-in clamps on the back side of the decorative cover thereby releasing the upper portion of the pin assembly. Then remove the point of the pin 110 from the guard 106 on the back side of the decorative cover.

Insert the point of the pin into and through the desired material, insuring that post 105 is parallel to the material and over or on top of the leg of the pin 109. This will insure that post 105 is in proper position to be received by the snap-in clamps 104 on the back side of decorative cover 101 when reattaching the pin assembly to the decorative cover. Then insert the point of the pin back through the material in the desired place. Done properly this will allow a reasonable amount of space 112 for the thickness of the material between the decorative cover and the pin assembly when reattached. The amount of space 112 is dependent on the diameter of the post and the outward bend of the guard plate.

Figure 9:
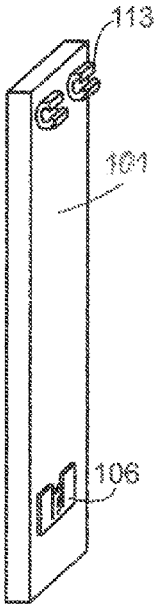
FIG. 9 is a perspective view of the right side of a decorative cover without the pin assembly shown in FIG. 2.

Once the pin assembly is fastened to the material simply secure the point of the pin into the guard and push the post ends past the openings of the snap-in clamps 113 shown in FIG. 9 and into the cradle of the snap-in clamps and insuring the leg of the pin is midway between the snap-in clamps.

FIGS. 1, 16, 17

Additional Embodiments

Figure 16:
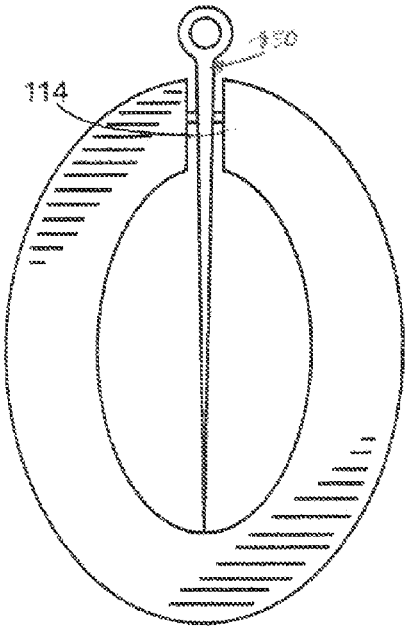
FIG. 16 is a front view of an alternate embodiment of the decorative cover shown in FIG. 1.
Figure 17:
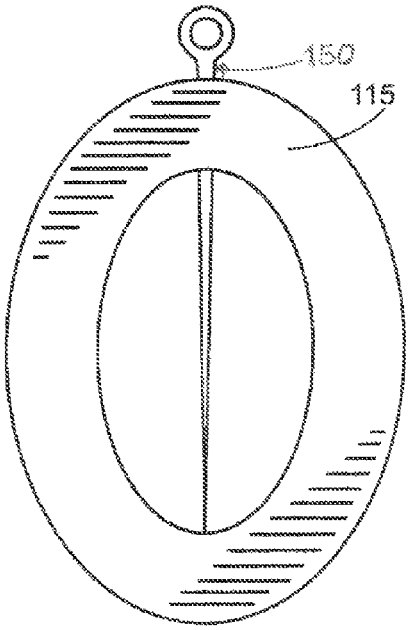
FIG. 17 is a front view of an alternate embodiment of the decorative cover shown in FIG. 1.

The decorative cover can be a solid shape 101 with any type of design 102 for example as shown in FIG. 1 or a non-solid shape as in FIG. 16 front view and FIG. 17 front view. So any shape that is solid but has an open center 115 or broken shape with open center 114 can be the decorative cover. The points of contact are two snap-in clamps, one to both post arms almost to the end, and the point of the pin to the guard. There are the three points of contact between the decorative cover and the pin assembly but additional snap in clamps can be added or the decorative cover can have one snap-in clamp. Additional pins or post could also be added.

FIGS. 3, 11, 13, 14, 15, 18, 19, 20, 21

Alternate Embodiments

The three points of contact allow for a wide variety of different shapes to the decorative cover. The snap in clamps can be any type of securing device for the post or can be a type of securing device to one end of the post and a snap-in clamp on the other post. Adding additional snap-in clamps can is also possible and can also be any other type of securing device or in any combination with the snap-in clamps. The guard can be any type of latch or cover and in any combination if more pins are used. Pins can also be added.

Figure 13:
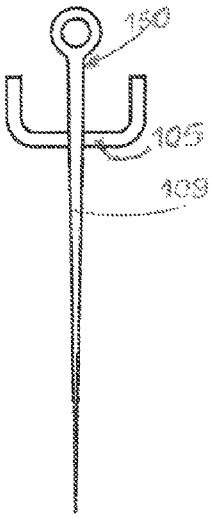
FIG. 13 is a front view of an alternate embodiment of the pin assembly shown in FIG. 3.
Figure 14:
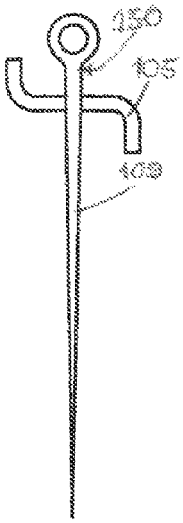
FIG. 14 is a front view of an alternate embodiment of the pin assembly shown in FIG. 3.
Figure 15:
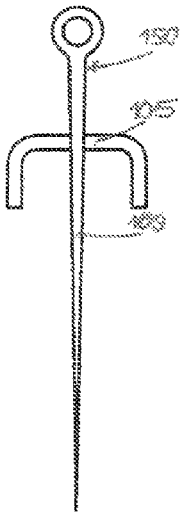
FIG. 15 is a front view of an alternate embodiment of the pin assembly shown in FIG. 3.
Figure 18:
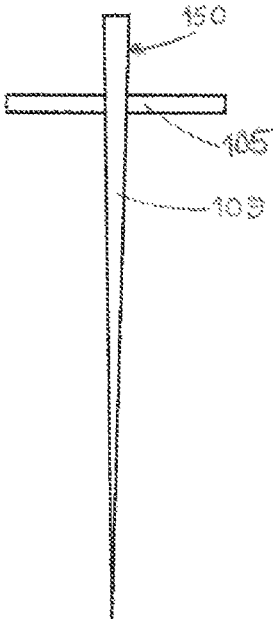
FIG. 18 is a front view of an alternate pin assembly shown in FIG. 2.
Figure 19:
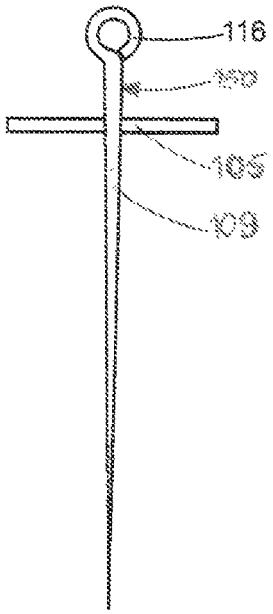
FIG. 19 is a front view of an alternate pin assembly shown in FIG. 2.
Figure 20:
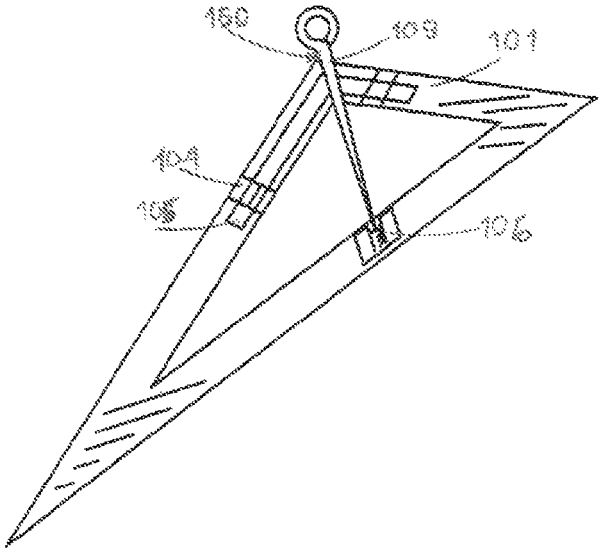
FIG. 20 is aback view of an alternate embodiment of the pin in FIG. 2.
Figure 21:
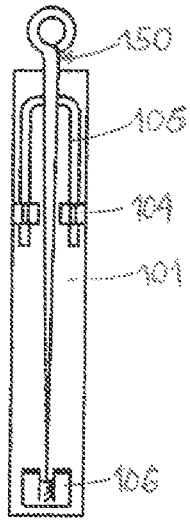
FIG. 21 is aback view of an alternate embodiment of the pin in FIG. 2.

The leg of the pin need not be straight. The loop can be any shape, thickness and size to allow a chain to be attached. The loop can be added to the post by different methods like extending the pin leg to form the loop 116 in FIG. 19 and any other methods used to make jewelry. The loop can be removed from the pin assembly as shown in FIG. 18 or replaced by a hook, rounded knob or any other type of end. The eye 108 of the loop can be removed as also shown in FIG. 3. The post can be affixed to the pin at any angle or point on the post so one side is longer or shorter than the other. The post can be bent to any shape and a few examples are shown in FIG. 13, FIG. 14, and FIG. 15 wherein the post includes a protrusion extending from each end thereof. The post can have one bend as shown in FIG. 20, two as shown in FIG. 21 or more. The bumps at both ends of the post can be replaced by capping the ends, beveling the post and changing the inside diameter of the snap-in clamp or any other method that will help align the post or stabilize the post from sliding out of the snap-in clamps. The bumps can also be any size and made of the same material as the post or any other material jewelry is made from like adhesive, cement, etc.

Advantages

Figure 22:
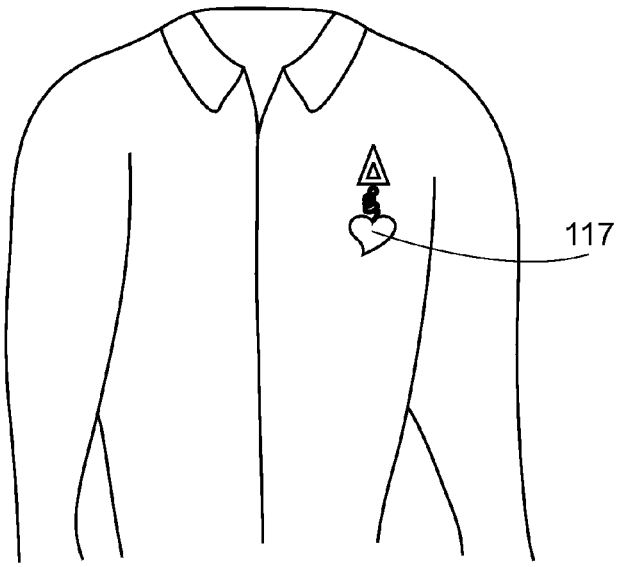
FIG. 22 illustrates the manner in which accessories are attached to an alternate embodiment of my pin shown in FIG. 1.
Figure 23:
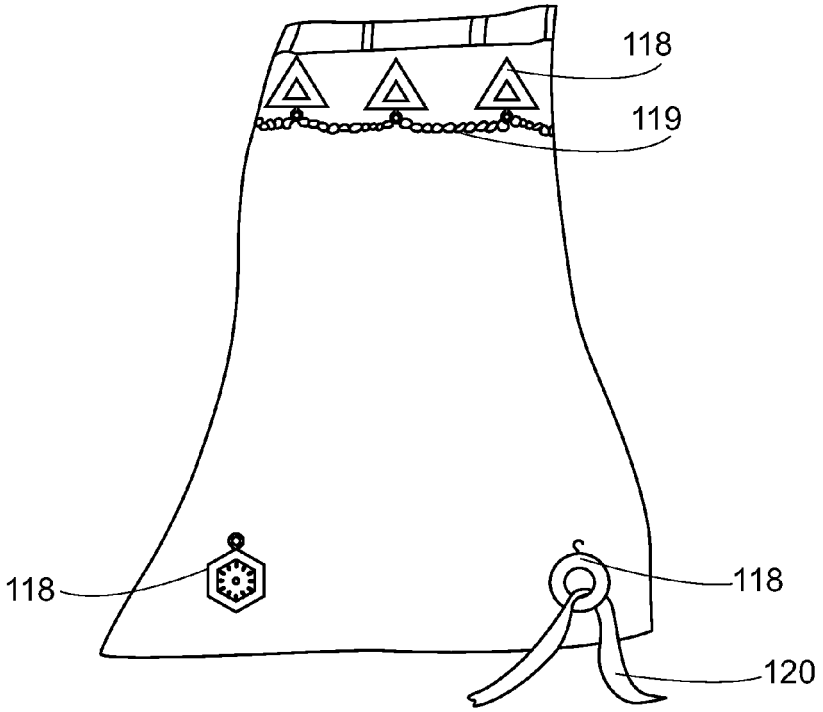
FIG. 23 illustrates the manner in which accessories are attached to an alternate embodiment of my pin shown in FIG. 1.

From the description above, a number of advantages of some of the embodiments of my pin become evident:

- It is simple and easy to install to material;
- Placement of the pin is more accurate without the cover shape in the way;
- All the parts are common to the jewelry industry, so there is no need to buy new machinery to manufacture the part;
- All the materials would also be common to jewelry and no more expensive;
- The three points of contact allow a whole variety of different shapes to be used for the decorative cover without the additional parts and complexity of the other pins and with more uses;
- Uses of the pin are not limited to jewelry pins for clothing, and can be used for arts and crafts, home décor, lapel pins, name tags, corsage pins, microphone pins, etc;
- The pin can be used to dangle an ornament 117 from as shown in FIG. 22; A chain can be attached to the pin or in a-combination of pins as shown in FIG. 23;
- Other fabric or material 120 can be drawn through an open centered shape 118, decorative cover, or multiple decorative covers;
- The open centered decorative cover can allow different types of ornaments to be attached to the front cover 118 but still allow a battery of an ornament to be replaced through the back cover of the ornament;
- So whether the ornament is a light, watch, or any item that requires a battery or recharging compartment, the cover will allow an individual to change or recharge the battery.

CONCLUSION, RAMIFICATIONS, AND SCOPE

Accordingly, the reader will see that my pin is a useful, simple and easy pin for any fabric type material. This would include adding designs to purses, shoes and other accessories. With the large variety of reusable fabric grocery bags being sold and used an individual can use my pin to attach coupons, glasses, or whatever other items the person would like to attach to the bag. The cost of manufacturing the pin would be comparable to or lower than other pins. With all the added uses an individual would not need to purchase so many specific type pins for their clothing. Better stabilization to the material without buying separate items to support the pin or a more expensive pin with the stabilization feature. Manufacturing the pin in different shapes, sizes, colors and a wide range of designs allows an individual to use this pin in other areas such as highlighting a plain colored curtain with other runners of colored fabric to enhance the color of a room. An individual can also use this pin to fix an article of clothing that they would use a safety pin for and unlike a safety pin they would not have to try to conceal the pin from view. This pin would be perfect to hide a flaw or add other ornaments to conceal bigger flaws without throwing away the article of clothing Therefore the Snap pin would be simple, easy, stable, inexpensive and functional all in one pin.

Although the description above contains specificities, these should not be construed as limiting the scope of the embodiments but merely providing illustrations of some of several embodiments. Thus the scope of the embodiments should be determined by the appended claims and their legal equivalents, rather than by the examples given.

I claim:

1. An attachment device for attaching an ornament to a material comprising:

a pin having a first and a second member, the first member having first and second ends, the second end defining a point, the second member being attached to the first member substantially perpendicular to the first member and proximate the first end of the first member;

the second member comprising a pair of arms, one arm extending outwardly from each side of the first member, the second member further comprising first and second protrusions extending one each, from the arms of the second member;

a clamp attachable to a rear side of an ornament, the clamp comprising two snap-in clamps spaced one from the other, each of the snap-in clamps defining an opening for removably receiving one of the arms of the second member of the pin;

a guard attachable to the rear side of the ornament, the guard being configured to receive the point of the second end of the first member of the pin; and the pin configured to extend through a material and couple with the clamp and guard for removably attaching the ornament to the material.

2. The attachment device of claim 1 wherein the first member of the pin defines an eye opening at the first end thereof.

3. An ornament comprising:

a pin having a first and a second member, the first member having first and second ends, the second end defining a point, the second member being attached to the first member substantially perpendicular to the first member and proximate the first end of the first member, the second member comprising a pair of arms, one arm extending outwardly from each side of the first member;

a decorative member defining a front side and a rear side and having each of a clamp and a guard attached to the rear side;

the clamp comprising two snap-in clamps spaced one from the other, each of the two snap-in clamps defining an opening, the openings configured to removably receive one of the arms of the second member of the pin;

the guard being configured to receive the point of the second end of the first member; and the pin configured to extend through a material and couple with the clamp and guard for removably attaching the decorative member to the material.

4. The ornament of claim 3 wherein the second member of the pin further comprises first and second protrusions extending one each from the arms.

5. The ornament of claim 3 wherein the first member of the pin defines an eye opening at the first end thereof.

6. The ornament of claim 3 wherein the decorative member defines an opening through the front and rear sides thereof.

7. The ornament of claim 3 wherein the decorative member further defines an opening in the periphery thereof.

* * * * *